US005415205A

United States Patent [19]

Stenhouse

[11] Patent Number: 5,415,205

[45] Date of Patent: May 16, 1995

[54] DOUBLE DENT REED WITH INCREASED SEPARATION BETWEEN FRONT AND BACK DENT ROWS

[75] Inventor: William L. Stenhouse, Greenville, S.C.

[73] Assignee: Steel Heddle Mfg. Co., Greenville, S.C.

[21] Appl. No.: 202,338

[22] Filed: Feb. 25, 1994

[51] Int. Cl.[6] ..... D03D 49/62

[52] U.S. Cl. ..... 139/192

[58] Field of Search ..... 139/192, 188, 191

[56] References Cited

U.S. PATENT DOCUMENTS

| | | | |
|---|---|---|---|
| 1,146,478 | 7/1915 | Coombs . | |
| 3,189,056 | 6/1965 | Parks . | |
| 3,770,024 | 11/1973 | Pfarrwaller | 139/188 R |
| 4,471,815 | 9/1984 | Wagner | 139/192 |
| 4,481,980 | 11/1984 | Stenhouse . | |
| 4,611,637 | 9/1986 | Huffman | 139/192 |

*Primary Examiner*—Andrew M. Falik

*Attorney, Agent, or Firm*—Dority & Manning

[57] ABSTRACT

A reed (28) for a loom includes a frame with upper and lower baulk mechanisms (D, E) that carry a front row (B) of dents (30) on the beat-up side of the frame and a back row (C) of dents (34) staggered in alignment with dents (30). Lower baulk mechanism (E) includes a stepped clamping portion which is reduced in depth compared to the depth of the upper portion of the lower baulk mechanism (E) such that dents (34) are shorter in height in the lower baulk mechanism (E) than dents (30). This renders one of the rows (C) of dents (34) able to be disposed farther from the other row (B) of dents (30) than if they were to extend into the clamping portion of the lower baulk mechanism (E) the same amount as dents (30). In this way, the angle of attack between the dents and the warp yarn ends is reduced and offers less resistance to the yarn passage, reducing abrasion of the warp yarns, reducing the lint buildup between the dents, and increasing efficiency by reducing the incidence of friction between adjacent warp yarns.

9 Claims, 5 Drawing Sheets

DOUBLE DENT REED WITH INCREASED SEPARATION BETWEEN FRONT AND BACK DENT ROWS

BACKGROUND OF THE INVENTION

The present invention relates to apparatus for manufacturing textiles on a textile loom and in particular to a double dent reed which spaces the individual warp ends on the loom and holds them parallel as the reed pushes the filling yarn into place at the fell of the fabric.

As each pick of the filling yarn is inserted through the shed of the warp yarns, the reed pushes the filling yarn against the already woven part of the fabric in an action commonly referred to as beat-up. Many types of cloth such as very fine fabrics, require a large number of warp yarn ends per inch of reed. It is difficult, if not impossible, to arrange the dents to provide a passage space for each warp end. A problem occurs because the warp yarns forming a shed for insertion of the filling yarn to pass, often stick or cling together due to their close proximity to one another. Maintaining the warp ends parallel becomes difficult during shedding and beating-up. This sticking can also result in breakages when the reed moves forward over the warp yarn ends during beat-up. Slubs, knots, and other imperfections in the individual warp yarn ends also tend to catch on the dents due to the narrow spacing therebetween which causes breakage of the warp yarn ends. Warp breaks result in time consuming loom stops or fabric imperfections, both of which are costly in terms of time and production.

The double dent reed arose in an attempt to more evenly space the warp yarn ends and hold them parallel as the reed beats up each pick of the filling yarn. By the use of two rows of dents, the front row beats the filling yarn against the woven fabric and the dents in the back row of dents are arranged to more evenly space the warp ends. Since there are more dents to hold the yarns parallel without a corresponding decrease in spacing distance, the warp ends pass more freely through the reed. In this manner, ends are spaced more evenly without constriction of the passage spaces between dents. Typical of earlier double dent reed constructions are those shown in U.S. Pat. No. 1,146,478, Dutch Pat. No. 2,823,222, and British Pat. No. 8,525.

As shown in U.S. Pat. No. 4,481,980, which is hereby incorporated herein by this reference, a double dent reed typically includes a frame which carries two rows of dents between a plurality of upper support bars and a plurality of lower support bars. Channels, as in double dent reeds available from Sulzer of Switzerland, may be used in place of the support bars in constructing the frame that carries the two rows of dents.

In a double dent reed, each row of dents includes a plurality of wire dents which are spaced apart side by side along the length of the frame. As schematically shown in FIG. 6, the front row R1 of dents d1 is spaced staggered from the gaps G1 between the dents d2 in the back row R2 of dents d2. In a double dent reed available from Sulzer of Switzerland schematically shown in FIG. 6, there is a 1.7 mm open separation space S between the two rows R1, R2 of dents. The warp yarn ends 12 on the loom are guided through the gaps G1, G2 between the dents d1, d2. One side of the frame is clamped to a moving beam, commonly called a slay, on the loom. The slay moves the reed back and forth to produce the beat-up action. The inertial forces on the upper free side of the reed frame are considerable when utilized on high speed loom operations. One side of the reed is commonly referred to as the beat-up side as it faces the fell of the cloth being woven. The wire dents are normally fairly rigid so that they may beat up the filling yarn against the fabric already woven.

While double dent reeds are an improvement, it has been found that considerable resistance to the passing of the warp ends may still be had in the back row of dents due in part to their staggered positioning relative to the gaps between the dents in the front row. This staggered positioning of the dents in the back row, requires the warp yarns to assume a somewhat tortuous path through the reed. This is particularly a problem in the weaving of terry cloth because of the need to keep the pile ends loose so that the loops found in the terry cloth can be properly formed. The pile ends can be caught on the adjacent ground ends, which are under tension, resulting in pulls and other imperfections in the weave of the terry cloth. Moreover, the tortuous path of the yarn ends between the front and back rows of dents is itself a cause of abrasion of the yarn ends and also results in yarn breaks and the accumulation of lint and size between the rows of dents.

OBJECTS AND SUMMARY OF THE INVENTION

Accordingly, an important object of the present invention is to provide a double dent reed construction for a loom which permits the warp yarn ends to pass more freely through the dent spaces and reduces warp breakages, warp abrasion, and the accumulation of lint in the reed.

Another important object of the present invention is to provide a double dent reed construction for a high speed loom in which the separation space between the trailing edges of the dents in the row of dents on the beat-up side of the reed and leading edges of the dents in the row of dents on the clamping side of the reed, can be increased to reduce the angle of attack between the warp yarn ends and the dents during beat-up.

A further important object of the present invention is to provide a double dent reed construction for a loom which has a first and second row of staggered dents carried in the frame by means of upper and lower baulk mechanisms wherein at least the lower baulk mechanism is configured with a stepped clamping portion.

Still another important object of the present invention is to provide a double dent reed construction for a loom which has a first and second row of staggered dents carried in the frame by means of upper and lower baulk mechanisms wherein at least the lower baulk mechanism is configured as a two-tiered channel with the clamping portion stepped from the upper portion of the lower baulk mechanism.

Yet another important object of the present invention is to provide a double dent reed construction for a loom which has a first and second row of staggered dents carried in the frame by means of upper and lower baulk mechanisms formed as channels and wherein the ends of the dents are held in the channels with epoxy.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, the apparatus and method of the present invention can be summarized as follows.

The above objectives are accomplished according to the present invention by means of a reed construction which includes a first row of dents on the beat-up side of the frame and a second row of dents on the warp beam side of the frame. A separation space is disposed between the first and second rows of dents.

The dents of both rows are carried in the frame by means of upper and lower channels. The lower channel is provided with a two-tiered configuration wherein the upper portion has a greater depth than the clamping portion, which nonetheless has adequate structural strength for clamping on the slay of the loom by which the beat-up action is imparted to the reed.

The lengths of the dents in the second row are shorter than the lengths of the dents in the first row and thus do not extend into the clamping portion of the lower channel. Because only one row of dents extends into the clamping portion of the lower support channel in the reed construction of the present invention, a larger separation can be disposed between the two rows of dents than if both rows of dents were to extend into the clamping portion of the lower support channel. Thus, in the present invention, the separation space that exists between the trailing edges of the first row of dents and the leading edges of the second row of dents measures a distance that is increased over that available in the conventional construction of a double dent reed.

Because of this increased separation space available in the reed construction of the present invention, the angle of attack between the dents and the warp yarn ends in the reed construction of the present invention, is reduced over the angle of attack in a conventional double dent reed and offers less resistance to the yarn passage, thereby reducing the abrasion of the warp yarns, reducing the lint build-up between the dents, and increasing efficiency by offering a larger effective opening to the warp yarns.

Because of the stepped configuration of the clamping portion, a shim of 1 mm thickness can be used to protect the clamping portion of the reed from indentations by the socket screws which fix the reed in the slay.

The accompanying drawings, which are incorporated in and constitute a part of this specification, illustrate one embodiment of the invention and, together with the description, serve to explain the principles of the invention.

BRIEF DESCRIPTION OF THE DRAWINGS

The construction designed to carry out the invention will be hereinafter described, together with other features thereof.

The invention will be more readily understood from a reading of the following specification, which serves to explain the principles of the invention, and by reference to the accompanying drawings forming a part of the specification, wherein an example of the invention is shown and wherein.

DETAILED DESCRIPTION OF THE PREFERRED EMBODIMENTS

Reference now will be made in detail to the presently preferred embodiments of the invention, one or more examples of which are illustrated in the accompanying drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. The same numerals are assigned to the same components throughout the drawings and description.

Figure 1:
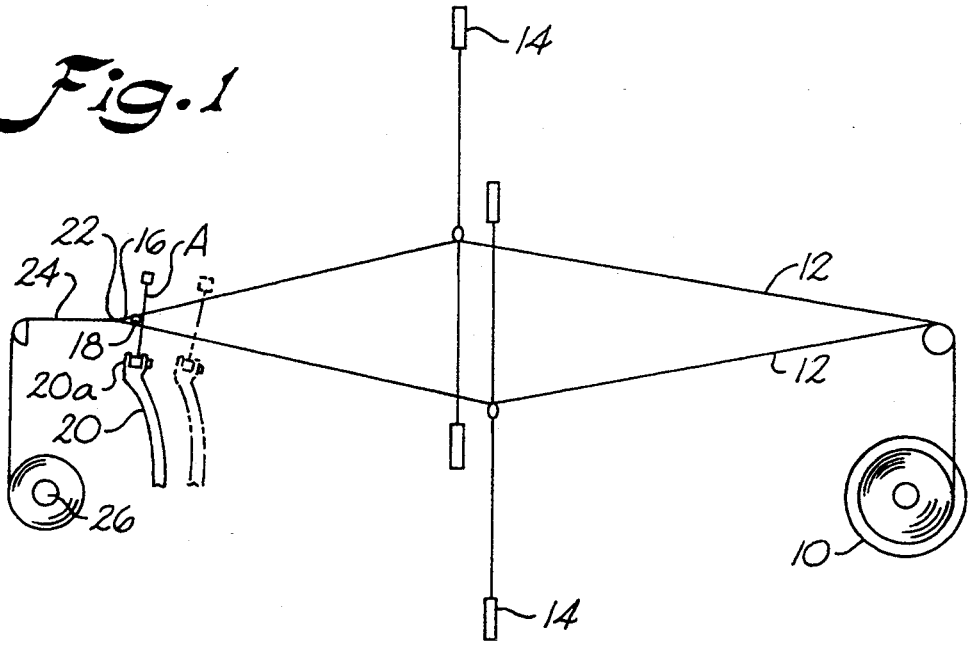
FIG. 1 is an elevation illustrating schematically the beat-up of a filling yarn on a textile loom by means of a reed.

The invention relates to a reed construction for a loom which beats the filling yarn against the already woven part of the fabric on the loom. As schematically shown in FIG. 1, the loom typically includes a warper beam 10 on which a plurality of warp yarn ends 12 are carried. The warp yarn ends are raised and lowered on the loom by means of harnesses 14 to form a shed 16 in which a filling yarn 18 is inserted.

As shown schematically in FIG. 1, a reed A is carried on a movable slay 20 by means of a clamp **20*a* on the end of the slay. After the filling yarn 18 is inserted, the slay is moved forward to the full line position and the reed pushes the filling yarn 18 against the fell 22 of the woven part of the fabric 24 previously woven. The woven fabric is then taken up on a cloth roll 26**.

Figure 2:
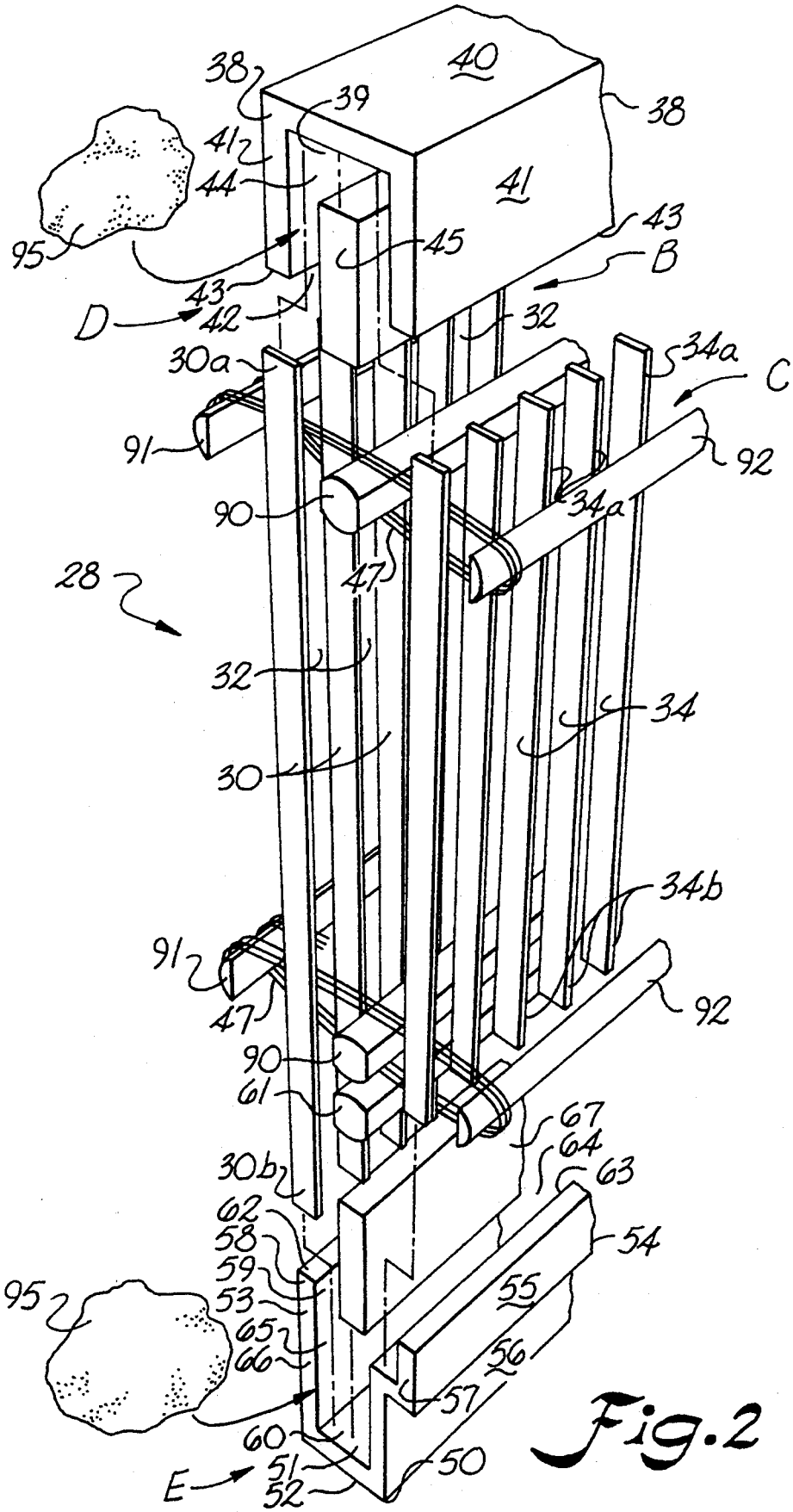
FIG. 2 is an elevation of a partial assembly view of a double dent reed construction according to the present invention.
Figure 3:
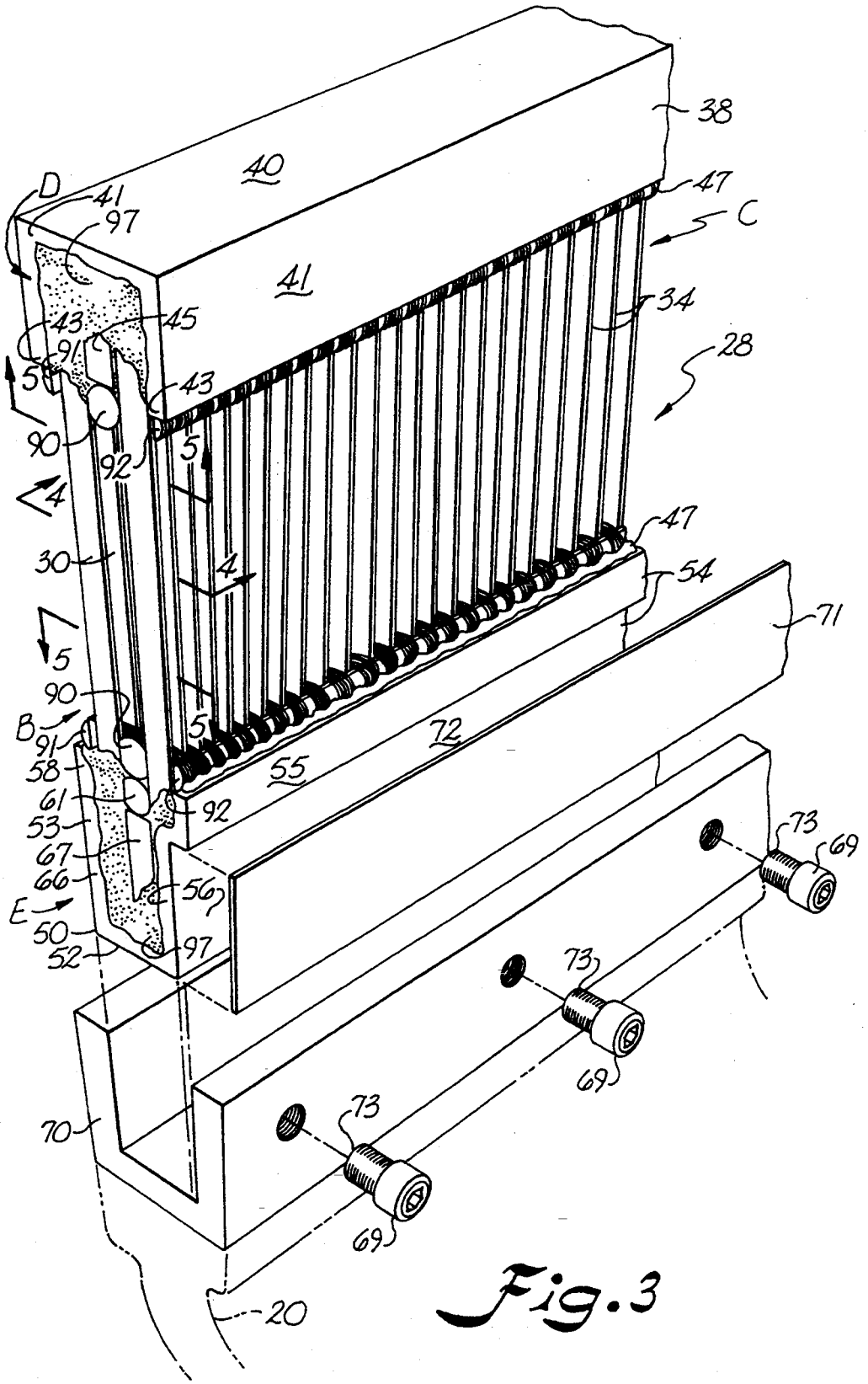
FIG. 3 is a partial, cut away front elevation of a double dent reed construction according to the present invention and shown in relation to the slay of the loom.
Figure 4:
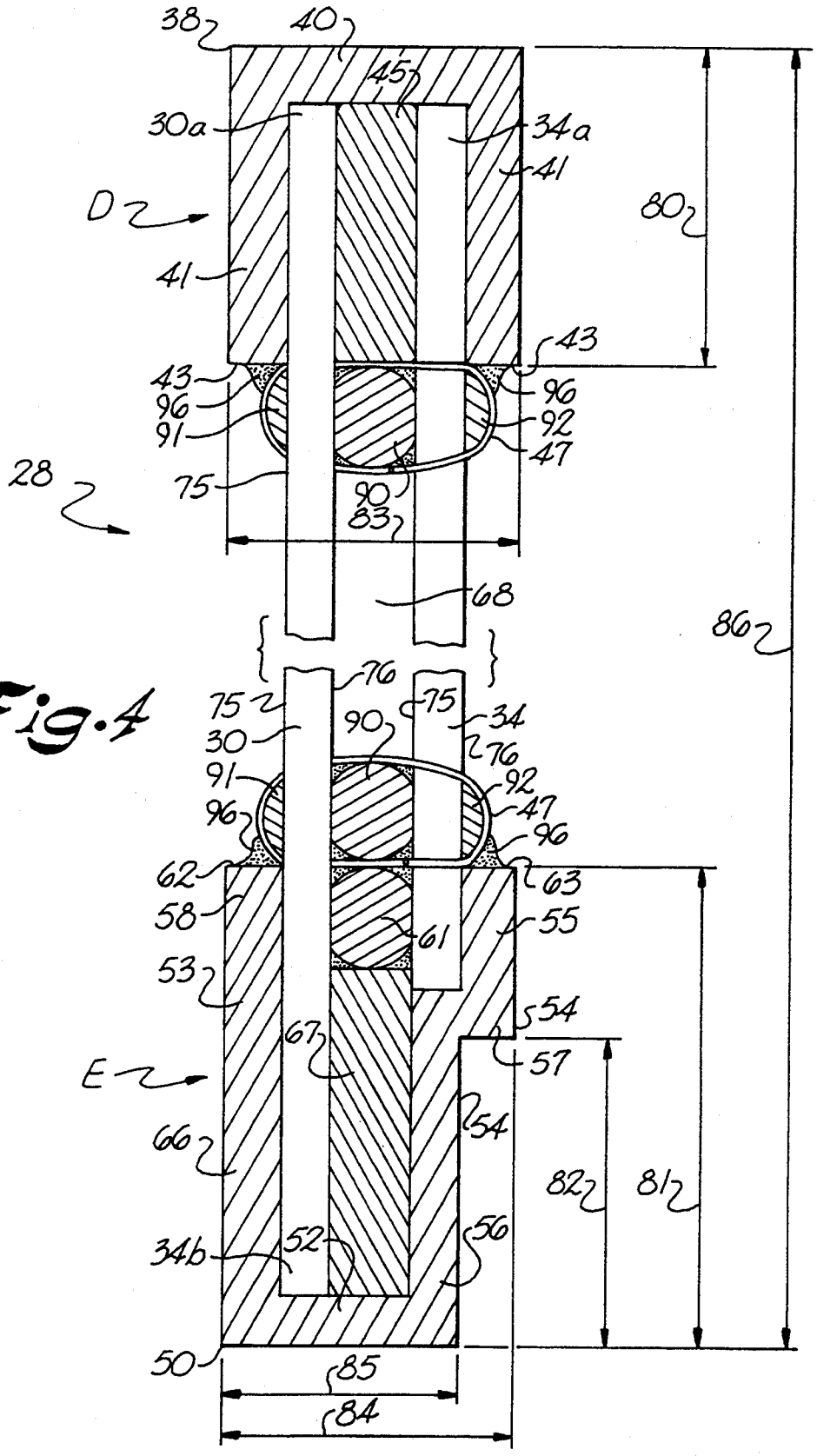
FIG. 4 is a sectional view of the double dent reed construction taken in the direction of the arrows 4—4 of FIG. 3.

A preferred embodiment of the double dent reed of the present invention is shown in FIGS. 2, 3 and 4 and is designated generally by the numeral 28. As shown in FIGS. 2, 3, 5 and 7, reed 28 includes a first plurality of dent wires 30 fixed in a side-by-side arrangement in a first or front row B of dents to define a plurality of dent gaps 32 (FIGS. 2 and 7) therebetween through which the individual warp yarn ends 12 (FIG. 7) pass. The first row B of dents 30 is illustrated on the beat-up side of the reed. The beat-up side of the reed is the side which beats the filling yarn against the already woven part of the fabric 24.

Figure 7:
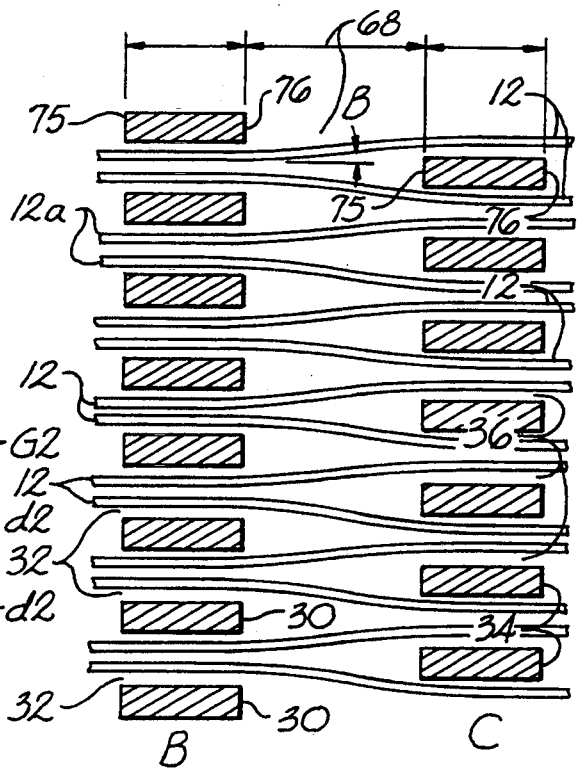
FIG. 7 schematically illustrates from a top sectional view taken in the direction of the arrows 5—5 of FIG. 3, what is meant by the angle of attack between the dents and the warp yarn ends in a reed construction of the present invention.

As shown in FIGS. 2, 3, 5 and 7, a second plurality of wire dents 34 is fixed in a side-by-side arrangement in a second or back row C that is disposed behind the first row B of dents 30 such that a separation space 68 (FIGS. 4 and 7) exists between the two rows of dents. As shown in FIGS. 2 and 7, a second plurality of dent gaps 36 is defined between the dents 34 of the second row C. In a preferred embodiment, each gap 32 between adjacent dents 30 is equal in size to each gap 36 between adjacent dents 34. As illustrated, the dents 34 of the second row C are carried about midway between the dents 30 of the first row B in a staggered relation. Thus, a pair of warp yarns 12*a* (FIG. 7) pass together through gaps 32 in the first row B of dents 30 for beat-up but are evenly spaced in a parallel relationship by means of the staggered dents 34 in the succeeding row C of dents 34 during shedding.

In accordance with the present invention, a double dent reed construction includes a frame for carrying two rows of dents in a fixed spatial relationship. In a preferred embodiment, the dents 30, 34 are formed of stainless steel. The two rows B, C of dents 30, 34 are held in their fixed relationship in the frame by means of an upper baulk mechanism and a lower baulk mechanism disposed opposite the upper baulk mechanism. As shown in FIG. 2, an upper baulk mechanism is designated generally by the letter D and provides a means for holding one set of opposing remote ends 30*a*, 34*a* of the first and second rows B, C of dents 30, 34 in a fixed relationship in the reed 28. Similarly, a lower baulk mechanism is designated generally by the letter E and provides a means for holding the opposite remote ends 30*b*, 34*b* of the two rows B, C of dents 30, 34 in a fixed relationship in the reed. Thus, the opposed remote ends 30*a* and 30*b* of the dents 30 of the front row B and the opposed remote ends 34*a* and 34*b* of dents 34 of the back row C are supported in the frame by means of an upper baulk mechanism D and a lower baulk mechanism E. Supporting end frame structure (not shown) at the ends of the reed 28 may be provided as required.

As shown in FIGS. 2, 3, and 4 for example, the upper baulk mechanism D includes an upper channel 38 in the form of a first rigid, elongated longitudinal beam that defines a first elongated longitudinal slot 39 (FIG. 2). Upper channel 38 desirably is formed in a rectangular configuration and has a top wall 40 that is connected between two opposing side walls 41. In a preferred embodiment, the top wall and side walls of the upper channel are formed as a unitary structure made of aluminum. As shown in FIG. 2, the free ends 43 of the side walls 41 define an entrance 42 into the first elongated slot 39 that extends between the two open ends 44 of the upper channel.

As shown in FIG. 2, the first slot 39 of upper channel 38 has a depth that is measured as the perpendicular distance between the two opposed side walls 41. The first slot 39 of upper channel 38 is configured to receive therein, side-by-side, one set of the remote ends 30*a* of a first row B of dents 30, one set of the remote ends 34*a* of a second row C of dents 34, and a first rectangular filler bar 45 disposed between these sets of the remote ends 30*a*, 34*a* of the first and second rows B, C of dents 30, 34, respectively. The interposed first rectangular filler bar 45 is configured to extend substantially the full length of first slot 39 of upper channel 38. Thus, the upper channel forms a support that carries one set of the remote ends 30*a*, 34*a* of the two rows B, C of dents 30, 34.

As shown in FIGS. 2, 3, and 4 for example, the lower baulk mechanism E includes a lower channel 50 in the form of a second rigid, elongated longitudinal beam that defines a second elongated longitudinal slot 51. The lower channel forms a support that carries one set of the remote ends 30*b*, 34*b* of the two rows B, C of dents 30, 34, respectively. Lower channel 50 desirably is formed in a two-tiered rectangular configuration and has a bottom wall 52, a front wall 53 that is integral with bottom wall 52, and a tiered back wall 54 that is integral with bottom wall 52 and disposed to oppose front wall 53. In a preferred embodiment, the bottom wall 52, front wall 53 and tiered back wall 54 of the lower channel are formed as a unitary structure made of aluminum. Back wall 54 has an upper back wall 55 connected to a lower back wall 56 by a riser member 57 extending between and perpendicular to both upper back wall 55 and lower back wall 56. As shown in FIG. 4, upper back wall 55 is disposed to oppose the upper portion 58 of front wall 53. Thus, the lower channel 50 has an upper portion defined by the upper portion 58 of front wall 53, a riser member 57, and upper back wall 55.

As shown in FIGS. 2, 3, and 4, the second slot 51 of lower channel 50 is tiered in an upper portion 59 (FIG. 2) and a lower portion 60 (FIG. 2). The upper portion 59 of tiered second slot 51 has a depth that is measured as the perpendicular distance between the upper portion 58 of front wall 53 and the opposed upper back wall 55. As shown in FIGS. 3 and 4, the measurements of depth dimensions 83, 84, 85 (FIG. 4) are taken in a direction transverse to the direction in which the dents 30 and dents 34 are disposed side-by-side (FIG. 3). The upper portion 59 of second slot 51 of lower channel 50 is configured to receive therein, side-by-side, the first row B of dents 30, one set of the remote ends 34*b* of a second row C of dents 34, and a first double flat-sided filler rod 61 disposed between the first and second rows B, C of dents 30, 34, respectively. The interposed first double flat-sided filler rod 61 is configured to extend substantially the full length of lower channel 50. This upper portion 59 of the lower channel 50 is the so-called dent-receiving portion 59 of lower channel 50 because it receives one set of the remote ends 34*b* of one row C of dents 34 and the other row B of dents 30 passes through this upper portion 59 of lower channel 50. The free end 62 of the upper portion 58 of the front wall 53 and the free end 63 of the upper back wall 55 define an entrance 64 into the upper portion 59 of second slot 51 that extends between the two open ends 65 of the lower channel.

Integral with the upper portion of the lower channel is a clamping portion of the lower channel. The clamping portion is configured so that the frame can be clamped on the slay 20 of the loom for movement during beat-up of a filling yarn on the loom. As shown in FIGS. 2, 3, and 4, the clamping portion of lower channel 50 includes lower back wall 56, bottom wall 52, and a lower portion 66 of front wall 53. Bottom wall 52 connects the lower portion 66 of front wall 53 to lower back wall 56. Because riser member 57 steps away from upper back wall 55 to connect to lower back wall 56, the clamping portion of lower channel 50 is said to be stepped from the upper portion of lower channel 50, and lower channel 50 is said to be a stepped lower channel 50.

The clamping or stepped portion 60 of second slot 51 of lower channel 50 is defined by lower back wall 56, bottom wall 52, and the lower portion 66 of front wall 53. The clamping portion 60 of second slot 51 of lower channel 50 is configured to receive therein, side-by-side, one set of the remote ends 30*b* of one row B of dents 30 and a second rectangular filler bar 67 disposed between one of either the leading edges 75 or trailing edges 76 of the dents 30 in the row B of dents 30 and one of either the lower back wall 56 or the lower portion 66 of front wall 53. As shown in FIG. 4, the interposed second rectangular filler bar 67 is configured to extend substantially the full length of the clamping portion 60 of second slot 51 of lower channel 50 and extends into the upper portion 59 of second slot 51 of lower channel 50.

The clamping portion 60 of tiered second slot 51 has a depth that is measured as the perpendicular distance between the lower portion 66 of front wall 53 and the opposed lower back wall 56. The upper portion 59 (a.k.a. dent receiving portion) of the tiered second slot 51 has a depth that is measured as the perpendicular distance between the upper portion 58 of front wall 53 and the opposed upper back wall 55. The upper portion 59 (a.k.a. dent receiving portion) of the tiered second slot 51 has a greater depth than the lower portion 60 or (a.k.a. clamping portion) of the tiered second slot 51, hence the stepped configuration. As shown in FIG. 3, this stepped configuration of the clamping portion of reed 28 enables reed 28 to be used in the bracket of a standard loom, yet provides the advantages of an increased separation space 68 between the two rows B, C of dents 30, 34.

As shown in FIGS. 2, 3, 4, and 5, the clamping portion 60 of second slot 51 of lower channel 50 is stepped from and integral with the upper portion 59 and is configured to receive one of the first and second rows of dents. The upper portion of the lower channel has a depth that is at least as great as the sum of the depths of the first and second rows B, C of dents 30, 34 and the separation space 68 (FIGS. 4 and 7) that is disposed between the first and second rows B, C of dents 30, 34. The stepped clamping portion of lower channel 50 is configured with a depth that is smaller than the depth of the upper portion of lower channel 50 by at least an amount equal to the depth of one of the first and second rows B, C of dents 30, 34. In the illustration of FIG. 2, the first row B of dents 30 is on the beat-up side of the reed, and the second row C of dents 34 is on the back side of the reed. Accordingly, in the embodiment shown, the stepped clamping portion of the lower channel 50 has a depth that is smaller than the upper portion of the lower channel by a distance equal to at least the depth of the second row C of dents 34.

As shown in FIG. 3, the reed 28 is fixed in the slay 20 (dashed line) with hexagon socket screws 69 threaded through a bracket 70 at regular intervals over its entire length. As shown in FIG. 3 for example, the stepped clamping portion of lower channel 50 is configured with a depth that is smaller than the depth of the dent-receiving portion by at least the depth of a shim 71 and the depth of one of the first and second rows B, C of dents 30, 34. When the reed is installed into the clamping bracket 70 of the slay 20, a thin one millimeter shim 71 for example can be disposed against the exterior surface 72 of the stepped lower clamping portion of the lower channel so that when the fastening screws 69 are tightened, the ends 73 of the screws 69 will press against the shim 71 rather than the exterior surface 72 of the stepped portion of lower channel 50 of the frame of the reed. This prevents indentations from being formed in the stepped portion of the lower channel. The ability to provide the lower channel with a reduced depth enables this protective shim to be used. In a preferred embodiment, the shim used with the clamping portion is formed of stainless steel.

As shown in FIGS. 4 and 7, each of the dents 30 or 34 defines a leading edge 75 and a trailing edge 76 facing opposite to the leading edge. Each of the trailing edges 76 is disposed toward the stepped clamping portion and away from the beat-up side of the reed when fixed into place in the upper and lower channels 38, 50.

Figure 6:
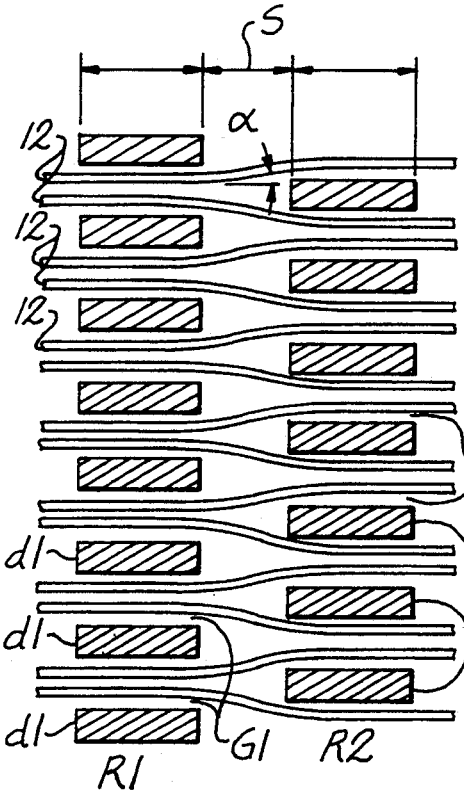
PRIOR ART Fig. 6
FIG. 6 schematically illustrates from a top sectional view taken in the direction of the arrows 5—5 of FIG. 3, what is meant by the angle of attack between the dents and the warp yarn ends in a prior art reed.

As shown in FIGS. 6 and 7, the tortuous path of the warp ends 12 through the gaps G1, G2 (FIG. 6); 32, 36 (FIG. 7) between front and back rows R1, R2 (FIG. 6); B, C (FIG. 7) of dents d1, d2 (FIG. 6); 30, 34 (FIG. 7) can be characterized by the angle of attack $\alpha$ (FIG. 6), $\beta$ (FIG. 7) that exists between the warp ends 12 and the dent as the dent approaches and then moves past the warp ends during each stroke of the beat-up motion of the reed. The larger this angle of attack, the more abrasion that is caused on the warp yarns. The larger this angle of attack, the more likely that the adjacent warp yarns will stick and or entangle during the stroke of the reed. For purposes of comparison, FIG. 6 shows the attack angle $\alpha$ in a conventional double dent reed and FIG. 7 shows the attack angle $\beta$ in a preferred embodiment of the double dent reed of the present invention. As illustrated by comparison of the attack angle $\alpha$ in the conventional double dent construction of FIG. 6 with the angle of attack $\beta$ of the reed construction of the present invention of FIG. 7, the increased separation space 68 between the front and back rows of dents in the reed of the present invention, reduces the attack angle $\beta$ of the warp yarns relative to the path of movement taken by the dents, as the yarn ends enter the front row B of dents 30 from the back row C of dents 34. A similar reduction in attack angle would be encountered when the reed moves in the opposite direction (to the dashed line position of slay in FIG. 1) as the warp yarns enter the back row C of dents 34 from the front row B of dents 30. The smaller this attack angle, the less abrasion that is caused on the warp yarns. Reducing this abrasion results in a reduction in the accumulation of lint and size between the rows of dents. The smaller this attack angle, the less likely that the warp yarns will become entangled, pulled or broken.

Thus, the stepped lower channel construction of the present invention permits an increase in the separation space 68 between the two rows B, C of dents 30, 34 over that obtainable in conventional reeds, thereby reducing the angle of attack so that less resistance is presented to the passages of the knots, slubs, and the warp yarn ends through the dent gaps 32, 36 and the adjacent warp ends are less likely to stick to one another. This also reduces the accumulation of lint which often occurs in the dent gaps of more closely spaced dent row constructions of double dent reeds.

The double dent reed of the present invention is particularly useful for weaving terry cloth. In a loom that is set up to weave terry cloth, a double dent reed is used to separate the pile ends (from which the loops in the terry cloth are formed) from the ground ends (which are maintained under tension on the loom) as this arrangement diminishes the likelihood that the ground ends will pull the pile ends during beat up and cause imperfections in the cloth. By reducing the angle of attack, the reed of the present invention further diminishes the likelihood that the ground ends will pull the pile ends during the weaving of the terry cloth.

Figure 5:
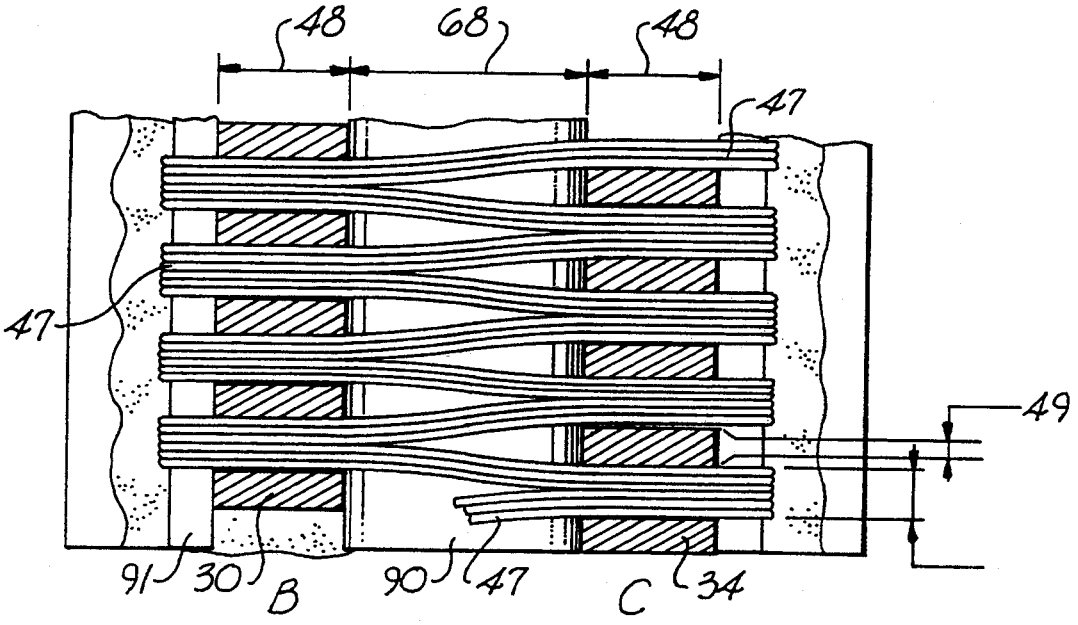
FIG. 5 is a sectional view taken in the direction of either set of the arrows 5—5 of FIG. 3.

While the dimensions can be varied according to the type of reed and loom that is desired, a preferred embodiment of a 70% air-space reed 28 is constructed with the following dimensions. Upper channel 38 has a height (80, FIG. 4) of 12.7 mm and lower channel 50 has a height (81, FIG. 4) of 25 mm with lower back wall (82, FIG. 4) having a height of 18 mm and upper back wall 55 having a height of 7 mm. The depth (83, FIG. 4) of upper channel 38 is 12.7 mm. The depth (84, FIG. 4) of the upper portion of lower channel 50 is 10.5 mm, and the depth (85, FIG. 4) of the clamping portion of lower channel 50 is 8 mm. As shown in FIG. 5, dents 30, 34 are formed with a thickness 49 of 0.022 inches and a depth 48 of 0.090 inches (2.3 mm). The separation space 68 between the trailing edges 76 of the front row B of dents 30 and the leading edges 75 of the back row C of dents 34 is 0.118 inches (3.1 mm). As shown in FIG. 5, the diameter of the wire 47 (described below) is 0.013 inches, and there are six windings of the wire 47 between the dents 30 in the front row B and six windings of the wire 47 between the dents 34 in the back row C, thus providing three windings between adjacent dents 30, 34 alternating from the front and the back rows B, C. The side-by-side gap 32 between adjacent dents, whether between adjacent dents 30 in row B or between adjacent dents 34 in row C, is 0.078 inches. The total length of each dent 30 in the front row B is about 96 mm, and the total length of each dent 34 in the back row C is about 78 mm. The working length of each dent 30 or 34 is about 52 mm. The overall height (86, FIG. 4) of the reed 28 is about 102 mm.

In a preferred embodiment shown FIGS. 3, 4, and 5, the upper baulk mechanism D includes a first double flat-sided rod 90 disposed between the first and second rows B, C of dents 30, 34 and at the entrance 42 of first slot 39. The lower baulk mechanism E further includes a second double flat-sided rod 90 disposed between the first and second rows B, C of dents 30, 34 and above the second slot 51 near the entrance 64 of the second slot 51. Each of the upper baulk mechanism and the lower baulk mechanism also includes a first elongated tying member 91. Each first tying member 91 has a flat side and a curved side disposed opposite to the flat side. Each first tying member 91 is disposed at the respective entrance 42, 64 of the respective slot 39, 51 of the respective upper channel 38 or lower channel 50 and with the flat side of the first tying member disposed against the leading edges 75 of the dents 30 in the first row B of dents 30. Each of the upper baulk mechanism D and the lower baulk mechanism E also includes a second elongated tying member 92. Each second tying member 92 has a flat side and a curved side disposed opposite to the flat side. Each second tying member 92 is disposed at the respective entrance 42, 64 of the respective slot 39, 51 of the respective upper channel 38 or lower channel 50 and with the flat side of the second tying member 92 disposed against the trailing edges 76 of the dents 34 in the second row C of dents 34. In a preferred embodiment, the tying members 91, 92, the double flat-sided rods 90, and the rectangular filler bars 45, 67 of the upper and lower baulk mechanisms D, E are formed of carbon steel.

As shown in FIGS. 2, 3, 4, and 5, each of the upper and lower baulk mechanisms D, E includes a wire 47 that is wound successively around the lengths of at least the first tying member 91, the double flat-sided rod 90, and the second tying member 92. As shown in FIG. 5 for example, the same number of windings of wire 47 is disposed between adjacent dents 30, 30 or 34, 34 in each of the first and second rows B, C of dents. Depending upon the side-by-side gaps 32 or 36 that are desired between the dents in each row of dents, the number of windings of the wire 47 between adjacent dents in a row and the diameter of the wire can be selected accordingly. In a preferred embodiment, the wire 47 is formed of stainless steel.

After the two rows B, C of dents 30, 34 are wired to the upper set of flat-sided rods 90, 91, 92 and the two rows B, C of dents 30, 34 are wired to the lower set of flat-sided rods 90, 91, 92, the opposed remote ends **30*a*, 30*b* or 34*a*, 34*b* of the dents 30, 34 may be affixed respectively within the upper or lower channels 38, 50 by any suitable means such as by bonding with a suitable thermoplastic adhesive such as disclosed in U.S. Pat. No. 3,189,056, which is incorporated herein by this reference. The first slot 39 of upper channel 38 and the second slot 51 of lower channel 50 are prepared by inserting the respective filler bars 45, 67 and pouring thermoplastic adhesive 95 (FIG. 2) such as epoxy into the first slot 39 of the upper channel and into both tiers of the second slot 51 of the lower channel. The evenly matched remote ends 30*a*, 34*a* of the two rows B, C of dents 30, 34 are inserted into the upper channel containing the epoxy. As shown in FIG. 4, insertion of the dents 30, 34 displaces some of the epoxy from the first slot, and the excess epoxy 96 that is displaced may be trimmed away. Similarly, the unevenly matched remote ends 30*b*, 34*b* of the two rows B, C of dents 30, 34 and flat-sided filler rod 61 are inserted into the lower channel, and the displaced epoxy 96 may be trimmed away. As shown partially broken away in the view of FIG. 3, the epoxy 97 is then allowed to harden to fix the dents 30, 34** in the frame of the reed.

While a preferred embodiment of the invention has been described using specific terms, such description is for illustrative purposes only, and it is to be understood that changes and variations may be made without departing from the spirit or scope of the following claims.

What is claimed is:

1. A reed construction for a textile loom that forms fabric by moving the reed, which is held by the slay, between the warp yarn ends to beat up filler yarns inserted into the shed formed between warp yarn ends, into the fell of the fabric, the reed comprising:

a frame having an upper baulk mechanism and a lower baulk mechanism disposed opposite said upper baulk mechanism;

a first row of dents having a depth and including a plurality of dents having opposing ends affixed respectively in said upper and lower baulk mechanisms in a side-by-side arrangement defining predetermined first dent spaces therebetween through which warp yarn ends on the loom may pass;

a second row of dents having a depth, said second row of dents being spaced apart from said first row of dents by a separation space and including a second plurality of dents having opposing ends affixed respectively in said upper and lower baulk mechanisms in a side-by-side arrangement defining predetermined second dent spaces therebetween through which warp yarn ends on the loom may pass;

said lower baulk mechanism being configured to form a dent-receiving portion and a stepped clamping portion integral with said dent receiving portion;

said dent-receiving portion of said lower baulk mechanism having a depth at least as great as the sum of the depths of said first and second rows of dents and said separation space disposed between said first and second rows of dents; and said stepped clamping portion being configured whereby said frame can be clamped on the slay of the loom for movement during beat-up of a filling yarn on the loom, said stepped clamping portion being further configured with a depth smaller than said depth of said dent-receiving portion.

2. A reed as in claim 1, wherein:

said depth of said stepped clamping portion being smaller than said depth of said dent-receiving portion by at least the depth of one of said first and second rows of dents.

3. A reed as in claim 1, wherein:

said stepped clamping portion being further configured with a depth smaller than said depth of said dent-receiving portion by at least the depth of a shim and the depth of one of said first and second rows of dents.

4. A reed as in claim 1, wherein:

said lower baulk mechanism including a rigid, elongated longitudinal beam defining an elongated longitudinal channel configured for receiving said first and second rows of dents therein and along the length thereof, said ends of said dents of said first and second rows being affixed within said channel with epoxy.

5. A reed as in claim 4, wherein said lower baulk mechanism including a rigid, elongated longitudinal beam defining an elongated longitudinal channel configured for receiving said first and second rows of dents therein and along the length thereof, said dents of said first and second rows having respective remote ends being affixed within said channel, said channel having an entrance;

each of said dents defining a leading edge and a trailing edge facing opposite said leading edge, each of said trailing edges being disposed toward said stepped clamping portion;

said lower baulk mechanism including a first double flat-sided rod disposed between said first and second rows of dents and within said channel;

said lower baulk mechanism including a second double flat-sided rod disposed between said first and second rows of dents and above said channel near said entrance;

said lower baulk mechanism including a first elongated tying member, said first tying member having a flat side and a curved side disposed opposite said flat side, said first tying member being disposed at said entrance of said channel and with said flat side being disposed against said leading edges of said dents in said first row of dents;

said lower baulk mechanism including a second elongated tying member, said second tying member having a flat side and a curved side disposed opposite said flat side, said second tying member being disposed at said entrance of said channel and with said flat side being disposed against said trailing edges of said dents in said second row of dents; and a wire wound successively around and along the lengths of at least said first tying member, said second double flat-sided rod, and said second tying member, wherein the same number of windings is disposed between adjacent dents in each of said first and second rows.

6. A reed construction for a textile loom that forms fabric by moving the reed, which is held by the slay, between the warp yarn ends to beat up filler yarns inserted into the shed formed between warp yarn ends, into the fell of the fabric, the reed comprising:

a frame having an upper baulk mechanism and a lower baulk mechanism disposed opposite said upper baulk mechanism;

a first row of dents including a plurality of dents having opposing ends affixed respectively in said upper and lower baulk mechanisms in a side-by-side arrangement defining predetermined first dent spaces therebetween through which warp yarn ends on the loom may pass;

a second row of dents spaced apart from said first row of dents by a separation space and including a second plurality of dents having opposing ends affixed respectively in said upper and lower baulk mechanisms in a side-by-side arrangement defining predetermined second dent spaces therebetween through which warp yarn ends on the loom may pass; and said lower baulk mechanism including a rigid, elongated longitudinal beam defining an elongated longitudinal channel configured for receiving said first and second rows of dents therein and along the length thereof, said beam having an upper portion configured to receive said first and second rows of dents, said beam having a clamping portion that is configured whereby said frame can be clamped on the slay of the loom for movement during beat-up of a filling yarn on the loom, said clamping portion being stepped from and integral with said upper portion and configured to receive one of said first and second rows of dents, remote ends of one of said first and second rows of dents being disposed in said clamping portion without the other of said first and second rows of dents being disposed in said clamping portion.

7. A reed as in claim 6, wherein:

said stepped clamping portion being configured with a depth smaller than said depth of said upper portion of said beam by at least the depth of a shim and the depth of one of said first and second rows of dents.

8. A reed as in claim 6, wherein:

said upper portion of said beam having a depth at least as great as the sum of the depths of said first and second rows of dents and said separation space disposed between said first and second rows of dents; and said stepped clamping portion of said beam being configured with a depth smaller than said depth of said upper portion of said beam by at least the depth of one of said first and second rows of dents.

9. A reed as in claim 6, wherein:

each of said dents in one of said first and second rows of dents is longer than each of said dents in the other of said first and second rows of dents.

* * * * *